US007645345B2

(12) United States Patent
Baum et al.

(10) Patent No.: US 7,645,345 B2
(45) Date of Patent: Jan. 12, 2010

(54) USE OF COPOLYMERS CONTAINING SULFONIC ACID GROUPS, AS AN ADDITIVE IN DETERGENTS AND CLEANSERS

(75) Inventors: Pia Baum, Frankenthal (DE); Kathrin Michl, Ludwigshafen (DE); Franz Weingart, Weinheim (DE); Stephan Nied, Neustadt/Wstr. (DE); Gregor Brodt, Heppenheim (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 12/181,900

(22) Filed: Jul. 29, 2008

(65) Prior Publication Data

US 2008/0281053 A1 Nov. 13, 2008

Related U.S. Application Data

(62) Division of application No. 10/515,638, filed as application No. PCT/EP03/05821 on Jun. 4, 2003, now abandoned.

(30) Foreign Application Priority Data

Jun. 10, 2002 (DE) ..... 102 25 794

(51) Int. Cl.
*B08B 3/04* (2006.01)
*C11D 3/37* (2006.01)

(52) U.S. Cl. ..... 134/25.2; 134/25.3; 510/223; 510/229; 510/230; 510/434; 510/475; 510/476; 510/477

(58) Field of Classification Search ..... 510/223, 510/229, 230, 434, 475, 476, 477; 134/25.2, 134/25.3
See application file for complete search history.

(56) References Cited

U.S. PATENT DOCUMENTS 5,760,154 A * 6/1998 Krause et al. ..... 527/311

FOREIGN PATENT DOCUMENTS

JP 2000024691 * 1/2000

* cited by examiner

*Primary Examiner*—Brian P Mruk
(74) *Attorney, Agent, or Firm*—Oblon, Spivak, McClelland, Maier & Neustadt, L.L.P.

(57) ABSTRACT

Use of copolymers containing sulfonic acid groups which comprise (a) 30 to 95 mol % of at least one monoethylenically unsaturated carboxylic acid, one monoethylenically unsaturated carboxylic ester or one water-soluble salt of a monoethylenically unsaturated carboxylic acid, (b) 3 to 35 mol % of at least one monomer containing sulfonic acid groups of the formula I

I

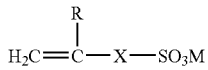

in which the variables have the following meanings:
R is hydrogen or methyl;
X is a chemical bond or —COO—$R^1$—;
$R^1$ is unbranched or branched $C_1$-$C_4$-alkylene;
M is hydrogen, alkali metal or ammonium,
and (c) 2 to 35 mol % of at least one nonionic monomer of the formula II

II

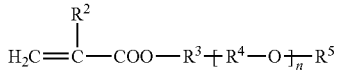

in which the variables have the following meanings:
$R^2$ is hydrogen or methyl;
$R^3$ is a chemical bond or unbranched or branched $C_1$-$C_6$-alkylene;
$R^4$ are identical or different unbranched or branched $C_2$-$C_4$-alkylene radicals;
$R^5$ is unbranched or branched $C_1$-$C_6$-alkyl, $C_5$-$C_8$-cycloalkyl or aryl;
n is 3 to 50, in random or block copolymerized form, as additive for detergents and cleaners.

15 Claims, No Drawings

USE OF COPOLYMERS CONTAINING SULFONIC ACID GROUPS, AS AN ADDITIVE IN DETERGENTS AND CLEANSERS

This application is a Divisional of U.S. application Ser. No. 10/515,638, filed on May 13, 2005 now abandoned, which is a National Stage of PCT/EP03/05821, filed on Jun. 4, 2003.

The present invention relates to the use of copolymers containing sulfonic acid groups which comprise (a) 30 to 95 mol % of at least one monoethylenically unsaturated carboxylic acid, one monoethylenically unsaturated carboxylic ester or one water-soluble salt of a monoethylenically unsaturated carboxylic acid, (b) 3 to 35 mol % of at least one monomer containing sulfonic acid groups of the formula I

I

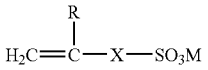

in which the variables have the following meanings:

R is hydrogen or methyl;

X is a chemical bond or —COO—$R^1$—;

$R^1$ is unbranched or branched $C_1$-$C_4$-alkylene;

M is hydrogen, alkali metal or ammonium, and (c) 2 to 35 mol % of at least one nonionic monomer of the formula II

II

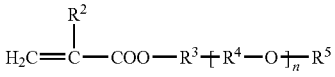

in which the variables have the following meanings:

$R^2$ is hydrogen or methyl;

$R^3$ is a chemical bond or unbranched or branched $C_1$-$C_6$-alkylene;

$R^4$ are identical or different unbranched or branched $C_2$-$C_4$-alkylene radicals;

$R^5$ is unbranched or branched $C_1$-$C_6$-alkyl, $C_5$-$C_8$-cycloalkyl or aryl;

n is 3 to 50, in random or block copolymerized form, as additive for detergents and cleaners.

The invention further relates to detergents and cleaners which comprise these copolymers as deposit-inhibiting additive.

In the case of machine dishwashing, the ware should be obtained in a residue-free cleaned state with a flawlessly gleaming surface, for which a detergent, a rinse aid and regenerating salt for water softening usually have to be used.

The "2 in 1" dishwashing detergents on the market comprise, in addition to the detergent for removing the soilings on the ware, integrated clear-rinse surfactants which, during the clear-rinse and drying operation, ensure flat water run-off on the ware, thus preventing lime and water marks. The topping-up of a rinse aid is no longer required with the use of these products.

Modern machine dishwashing detergents, "3 in 1" detergents, are intended to combine the three functions of the detergent, the rinse aid and the water softening in a single detergent formulation, meaning that the topping-up of salt for water hardnesses from 1 to 3 also becomes superfluous for the consumer. To bind the hardness-forming calcium and magnesium ions, sodium tripolyphosphate is usually added to these detergents. However, these in turn result in calcium and magnesium phosphate deposits on the ware.

WO-A-02/04583 describes machine dishwashing detergents which comprise copolymers of unsaturated carboxylic acids, monomers containing sulfonic acid groups and optionally, but preferably no, further nonionic monomers based on ethylenically unsaturated compounds as deposit inhibitors. Further information regarding the nonionic monomers is not given.

EP-A-877 002 relates to the use of copolymers of monoethylenically unsaturated acids, unsaturated sulfonic acids and optionally monoethylenically unsaturated dicarboxylic acids and monoethylenically unsaturated comonomers as inhibitor for (poly)phosphate deposits in machine dishwashing detergents. Specifically, it disclosed copolymers of acrylic acid and 2-acrylamido-2-propanesulfonic acid or sodium methallylsulfonate, and also terpolymers which additionally contain tert-butylacrylamide in copolymerized form. Nonionic monomers of the formula II are not mentioned.

According to JP-A-2000/7734, water-soluble copolymers which have structural units containing sulfonate groups, carboxylate groups and polyalkylene oxide groups and an average molecular weight $M_w$ of >50 000 to 3 000 000, can be used as agents for combating 5 scale, particularly that based on silicates, in water cycles, e.g. cooling systems. The sulfonate-containing structural unit of the specifically disclosed copolymers is based on sodium 2-methyl-1,3-butadiene-1-sulfonate.

In DE-A-43 43 993, graft copolymers of monoethylenically unsaturated carboxylic acids, monoethylenically unsaturated monomers containing sulfonic acid groups and optionally water-soluble monomers containing alkylene oxide units, and further free-radically polymerizable monomers onto polyhydroxy compounds are used for inhibiting water hardness in detergents and cleaners. Specifically, graft copolymers of acrylic acid, sodium methallylsulfonate and methoxypolyethylene glycol methacrylate onto polyvinyl alcohol, triglycerol and starch dextrin are described.

Finally, EP-A-278 983 discloses the use of copolymers of polyalkylene glycol mono(meth)acrylates, sulfoalkyl (meth) acrylates and (meth)acrylic acid as water-soluble dispersant or carbon-containing solids.

It is an object of the present invention to remedy the problems described above and to provide an additive which can be used advantageously especially in multifunctional cleaners and at the same time, in particular, exhibits a deposit-inhibiting action.

We have found that this object is achieved by the copolymers containing sulfonic acid groups which comprise (a) 30 to 95 mol % of at least one monoethylenically unsaturated carboxylic acid, one monoethylenically unsaturated carboxylic ester or one water-soluble salt of a monoethylenically unsaturated carboxylic acid, (b) 3 to 35 mol % of at least one monomer containing sulfonic acid groups of the formula I

I

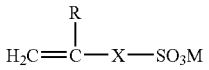

in which the variables have the following meanings:

R is hydrogen or methyl;

X is a chemical bond or —COO—$R^1$—;

$R^1$ is unbranched or branched $C_1$-$C_4$-alkylene;

M is hydrogen, alkali metal or ammonium, and (c) 2 to 35 mol % of at least one nonionic monomer of the formula II

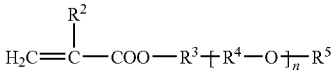

II in which the variables have the following meanings:

$R^2$ is hydrogen or methyl;

$R^3$ is a chemical bond or unbranched or branched $C_1$-$C_6$-alkylene;

$R^4$ are identical or different unbranched or branched $C_2$-$C_4$-alkylene radicals;

$R^5$ is unbranched or branched $C_1$-$C_6$-alkyl, $C_5$-$C_8$-cycloalkyl or aryl;

n is 3 to 50, in random or block copolymerized form, as additive for detergents and cleaners.

We have also found detergents and cleaners which comprise the copolymers containing sulfonic acid groups as deposit-inhibiting additive.

The copolymers containing sulfonic acid groups comprise, as copolymerized component (a) monoethylenically unsaturated carboxylic acids, their esters and/or water-soluble salts, where the carboxylic acids themselves or their salts are preferred as component (a).

Suitable components (a) are, for example, α, β-unsaturated monocarboxylic acids which preferably have 3 to 6 carbon atoms, such as acrylic acid, methacrylic acid, 2-ethylpropenoic acid, crotonic acid and vinylacetic acid.

Also suitable are, for example, unsaturated dicarboxylic acids which preferably have 4 to 6 carbon atoms, such as itaconic acid and maleic acid.

Suitable esters are, in particular, the reaction products of these acids with $C_1$-$C_6$-alcohols, especially methanol, ethanol and butanol, where the dicarboxylic acids may be in the form of the mono- or diesters. Examples which may be mentioned are: methyl acrylate, methyl methacrylate, ethyl acrylate, ethyl methacrylate, butyl acrylate, butyl methacrylate, monomethyl maleate and dimethyl maleate.

The salts are preferably alkali metal salts, e.g. sodium or potassium salts, or ammonium salts, preference being given to the sodium salts.

Preferred carboxylic acids (a) are acrylic acid, methacrylic acid and maleic acid.

Particular preference is given to acrylic acid and methacrylic acid, which may advantageously also be present together in the copolymers.

The proportion of carboxylic acids (a) in the copolymers to be used according to the invention is 30 to 95 mol %, preferably 50 to 90 mol % and particularly preferably 60 to 90 mol %.

If acrylic acid and methacrylic acid are present in the copolymers, then their molar ratio is preferably 15:1 to 0.05:1, in particular 10:1 to 1:1, especially 5:1 to 1:1.

As copolymerized component (b), the copolymers comprise monomers containing sulfonic acid groups of the formula I

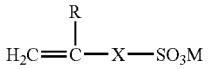

I in which the variables have the following meanings:

R is hydrogen or preferably methyl;

X is a chemical bond or preferably —COO—$R^1$;

$R^1$ is unbranched or branched $C_1$-$C_4$-alkylene, preferably $C_2$-$C_3$-alkylene;

M is hydrogen, ammonium or preferably an alkali metal.

Particularly suitable examples of the monomers I are: vinylsulfonic acid, 2-sulfoethyl(meth)acrylic acid, 2-sulfopropyl(meth)acrylic acid, 3-sulfopropyl(meth)acrylic acid and 4-sulfobutyl(meth)acrylic acid and salts thereof, in particular the sodium salts, where vinylsulfonic acid, 2-sulfoethylmethacrylic acid and 2-sulfopropylmethacrylic acid and sodium salts are preferred and 2-sulfoethylmethacrylic acid and its sodium salt are particularly preferred.

The proportion of monomers (b) containing sulfonic acid groups in the copolymers to be used according to the invention is 3 to 35 mol %, preferably 5 to 25 mol % and in particular 5 to 20 mol %.

The copolymers further comprise, as component (c), nonionic monomers of the formula II

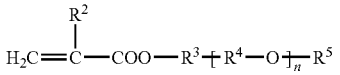

II in which the variables have the following meanings:

$R^2$ is hydrogen or preferably methyl;

$R^3$ is unbranched or branched $C_1$-$C_6$-alkylene or preferably a chemical bond;

$R^4$ are identical or different unbranched or branched $C_2$-$C_4$-alkylene radicals, especially $C_2$-$C_3$-alkylene radicals, in particular ethylene;

$R^5$ is aryl, especially phenyl or naphthyl, each of which may be substituted by alkyl, $C_5$-$C_8$-cycloalkyl, especially cyclohexyl, or preferably unbranched or branched $C_1$-$C_6$-alkyl, in particular $C_1$-$C_2$-alkyl;

n is 3 to 50, preferably 5 to 40, particularly preferably 10 to 30.

Particularly suitable examples of the monomers II which may be mentioned are: methoxypolyethylene glycol (meth)acrylate, methoxypolypropylene glycol (meth)acrylate, methoxypolybutylene glycol (meth)acrylate, methoxypoly(propylene oxide-co-ethylene oxide) (meth)acrylate, ethoxypolyethylene glycol (meth)acrylate, ethoxypolypropylene glycol (meth)acrylate, ethoxypolybutylene glycol (meth)acrylate, ethoxypoly(propylene oxide-co-ethylene oxide) (meth)acrylate, phenoxypolyethylene glycol (meth)acrylate, p-nonylphenoxypolyethylene glycol (meth)acrylate, naphthoxypolyethylene glycol (meth)acrylate, phenoxypolypropylene glycol (meth)acrylate, naphthoxypolypropylene glycol (meth)acrylate, p-methylphenoxypolyethylene glycol (meth)acrylate and cyclohexoxypolyethylene glycol (meth)acrylate, where methoxypolyethylene glycol (meth)acrylate and methoxypolypropylene glycol (meth)acrylate are preferred and methoxypolyethylene glycol methacrylate is particularly preferred.

The polyalkylene glycols here contain 3 to 50, in particular 10 to 30, alkylene oxide units.

The proportion of the nonionic monomers (c) in the copolymers to be used according to the invention is 2 to 35 mol %, preferably 5 to 25 mol % and especially 5 to 20 mol %.

The copolymers to be used according to the invention usually have an average molecular weight $M_w$ of from 3 000 to 40 000, preferably from 10 000 to 30 000 and particularly preferably from 15 000 to 25 000.

The K value of the copolymers is usually 15 to 35, in particular 20 to 32, especially 27 to 30 (measured in 1% strength by weight aqueous solution at 25° C., in accordance with H. Fikentscher, Cellulose-Chemie, Vol. 13, pp. 58-64 and 71-74 (1932)).

The copolymers to be used according to the invention can be prepared by free radical polymerization of the monomers. In this connection, it is possible to work in accordance with any known free radical polymerization process. In addition to bulk polymerization, mention may be made in particular of the processes of solution polymerization and emulsion polymerization, preference being given to solution polymerization.

The polymerization is preferably carried out in water as solvent. It can, however, also be carried out in alcoholic solvents, in particular $C_1$-$C_4$-alcohols, such as methanol, ethanol and isopropanol, or mixtures of these solvents with water.

Suitable polymerization initiators are compounds which either decompose thermally or photochemically (photoinitiators) to form free radicals.

Of the thermally activatable polymerization initiators, preference is given to initiators with a decomposition temperature in the range from 20 to 180° C., in particular from 50 to 90° C. Examples of suitable thermal initiators are inorganic peroxo compounds, such as peroxodisulfates (ammonium and preferably sodium peroxodisulfate), peroxosulfates, percarbonates and hydrogen peroxide; organic peroxo compounds, such as diacetyl peroxide, di-tert-butyl peroxide, diamyl peroxide, dioctanoyl peroxide, didecanoyl peroxide, dilauroyl peroxide, dibenzoyl peroxide, bis(o-tolyl)peroxide, succinyl peroxide, tert-butyl peracetate, tert-butyl permaleate, tert-butyl perisobutyrate, tert-butyl perpivalate, tert-butyl peroctoate, tert-butyl perneodecanoate, tert-butyl perbenzoate, tert-butyl peroxide, tert-butyl hydroperoxide, cumene hydroperoxide, tert-butyl peroxy-2-ethylhexanoate and diisopropyl peroxydicarbamate; azo compounds, such as 2,2'-azobisisobutyronitrile, 2,2'-azobis(2-methylbutyronitrile) and azobis(2-amidopropane) dihydrochloride.

These initiators can be used in combination with reducing compounds as starter/regulator systems. Examples of such reducing compounds which may be mentioned are phosphorus-containing compounds, such as phosphorus acid, hypophosphites and phosphinates, sulfur-containing compounds, such as sodium hydrogen sulfite, sodium sulfite and sodium formaldehyde sulfoxylate, and hydrazine.

Examples of suitable photoinitiators are benzophenone, acetophenone, benzoin ether, benzyl dialkyl ketones and derivatives thereof.

Preferably, thermal initiators are used, preference being given to inorganic peroxo compounds, in particular sodium peroxodisulfate (sodium persulfate). It is particularly advantageous to use the peroxo compounds in combination with sulfur-containing reducing agents, in particular sodium hydrogensulfite, as redox initiator system. If this starter/regulator system is used, copolymers are obtained which contain $—SO_3^- Na^+$ and/or $—SO_4^- Na^+$ as end-groups and are characterized by particular cleaning power and deposit-inhibiting action.

Alternatively, it is also possible to use phosphorus-containing starter/regulator systems, e.g. hypophosphites/phosphinates.

The amounts of photoinitiator and/or starter/regulator system are to be matched to the substances used in each case. If, for example, the preferred system of peroxodisulfate/hydrogensulfite is used, then usually 2 to 6% by weight, preferably 3 to 5% by weight, of peroxodisulfate and usually 5 to 30% by weight, preferably 5 to 10% by weight, of hydrogensulfite, are used, in each case based on the monomers (a), (b) and (c).

If desired, it is also possible to use polymerization regulators. Suitable compounds are those known to the person skilled in the art, e.g. sulfur compounds, such as mercaptoethanol, 2-ethylhexyl thioglycolate, thioglycolic acid and dodecyl mercaptan. If polymerization regulators are used, their use amount is usually 0.1 to 15% by weight, preferably 0.1 to 5% by weight and particularly preferably 0.1 to 2.5% by weight, based on monomers (a), (b) and (c).

The polymerization temperature is usually 30 to 200° C., preferably 50 to 150° C. and particularly preferably 80 to 120° C.

The polymerization can be carried out under atmospheric pressure, although it is preferably carried out in a closed system under the autogenous pressure which develops.

In the preparation of the copolymers to be used according to the invention, the monomers (a), (b) and (c) can be used as such, although it is also possible to use reaction mixtures which are produced during the preparation of, for example, the monomers (b) or (c). Thus, for example, instead of 2-sulfoethyl methacrylate, the monomer mixture which forms during the esterification of 2-hydroxyethanesulfonic acid with an excess of methacrylic acid can be used. Furthermore, instead of methoxypolyethylene glycol methacrylate, the monomer mixture produced during the etherification of methoxypolyethylene glycol with an excess of methacrylic acid can be used. It is likewise possible to prepare 2-sulfoethyl methacrylate and methoxypolyethylene glycol methacrylate by simultaneous or successive esterification of 2-hydroxyethanesulfonic acid and methoxypolyethylene glycol with an excess of methacrylic acid, and to use the resulting monomer mixture for the polymerization.

If desired for the application, the aqueous solutions produced during the preparation of the copolymers containing sulfonic acid groups to be used according to the invention can be neutralized or partially neutralized by adding a base, in particular sodium hydroxide solution, i.e. be adjusted to a pH in the range from about 4-8, preferably 4.5-7.5.

The copolymers containing sulfonic acid groups used according to the invention are highly suitable as additive for detergents and cleaners.

They can particularly advantageously be used in machine dishwashing detergents. They are characterized primarily by their deposit-inhibiting action both toward inorganic and also organic deposits. In particular, deposits which are caused by the other constituents of the cleaning formulation, such as deposits of calcium and magnesium phosphate, calcium and magnesium silicate and calcium and magnesium phosphonate, and deposits which originate from the soil constituents of the wash liquor, such as fat, protein and starch deposits should be mentioned. The copolymers used according to the invention thereby also increase the cleaning power of the dishwashing detergent. In addition, even in low concentrations, they favor run-off of the water from the ware, meaning that the amount of rinse-aid surfactants in the dishwashing detergent can be reduced. If the sulfonic acid group-containing copolymers are used, particularly clear glassware and gleaming metal cutlery items are obtained, particularly when the dishwasher is operated without regenerating salt to soften the water. The sulfonic acid group-containing copolymers can therefore be used not only in 2 in 1 detergents, but also in 3 in 1 detergents.

The copolymers used according to the invention can be used directly in the form of the aqueous solutions produced during the preparation, and also in dried form obtained, for example, by spray drying, fluidized spray drying, drum drying or freeze drying. The detergents and cleaners according to the invention can correspondingly be prepared in solid or in liquid form, e.g. as powders, granulates, extrudates, tablets, liquids or gels.

EXAMPLES

A) Preparation of copolymers containing sulfonic acid groups

The K values given below were determined in 1% strength by weight aqueous solution at 25° C. in accordance with H. Fikentscher, Cellulose-Chemie, Vol. 13, pp. 58-64 and 71-74 (1932).

The abbreviations used in the examples have the following meanings:

| | |
|---|---|
| AA: | acrylic acid |
| MAA: | methacrylic acid |
| MPEGMA: | methoxypolyethylene glycol methacrylate |
| SEMA: | 2-sulfoethylmethacrylic acid sodium salt |
| AMPA: | 2-acrylamido-2-methylpropanesulfonic acid |

Example 1

In a reactor fitted with nitrogen inlet, reflux condenser and metering device, a mixture of 782.7 g of distilled water and 1.98 g of phosphorous acid was heated to an internal temperature 45 of 100° C. with the introduction of nitrogen and with stirring. Then, a mixture of 144.8 g of acrylic acid, 306.8 g of a 50% strength by weight aqueous solution of methoxypolyethylene glycol methacrylate ($M_w$=1086), 241.3 g of distilled water and 34.5 g of 2-sulfoethylmethacrylic acid sodium salt (90% strength by weight) was added continuously over 5 h. In parallel to this, a mixture of 16.5 g of sodium peroxodisulfate and 148.1 g of distilled water were metered in continuously over 5.25 h, and 123.5 g of a 40% strength by weight aqueous sodium hydrogensulfite solution were continuously metered in over 5 h. Following after-stirring for 2 hours at 100° C., the reaction mixture was cooled to room temperature and adjusted to a pH of 7.2 by adding 154.5 g of 50% strength by weight sodium hydroxide solution.

This gave a slightly yellowish, clear solution of the copolymer of molecular composition AA:SEMA:MPEGMA=14:1:1 with a solids content of 22.6% by weight and a K value of 22.6.

Example 2

In the reactor from Example 1, a mixture of 300.0 g of distilled water and 1.09 g of phosphorous acid was heated to an internal temperature of 100° C. with the introduction of nitrogen and with stirring. Then, a mixture of 61.2 g of acrylic acid, 167.7 g of a 50% strength by weight aqueous solution of methoxypolyethylene glycol methacrylate ($M_w$=1086), 116.7 g of distilled water and 58.6 g of a mixture of 85.5% by weight of methacrylic acid and 14.5% by weight of 2-sulfoethylmethacrylic acid sodium salt was added continuously over 5 h. In parallel to this, a mixture of 5.4 g of sodium peroxodisulfate and 94.6 g of distilled water were metered in continuously over 5.25 h, and 27 g of a 40% strength by weight aqueous sodium hydrogensulfite solution were metered in continuously over 5 h. Following after-stirring for two hours at 100° C., the reaction mixture was cooled to room temperature and adjusted to a pH of 7.4 by adding 92 g of 50% strength by weight sodium hydroxide solution.

This gave a slightly yellowish, slightly opaque solution of the copolymer of molar composition AA:MAA:SEMA:MPEGMA=11:3:1:1 with a solids content of 24.8% by weight and a K value of 32.3.

Example 3

In the reactor from Example 1, a mixture of 505.1 g of distilled water and 1.18 g of phosphorous acid was initially introduced with the introduction of nitrogen and with stirring, and heated to an internal temperature of 100° C. without the introduction of further nitrogen. Then, a mixture of 42.9 g of acrylic acid, 88.6 g of a 50% strength by weight aqueous solution of methoxypolyethylene glycol methacrylate ($M_w$=1100), 197.9 g of distilled water, 17.6 g of 2-sulfoethylmethacrylic acid sodium salt and 47.0 g of methacrylic acid was added continuously over 5 h. In parallel to this, a mixture of 5.9 g of sodium peroxodisulfate and 53.0 g of distilled water were metered in continuously over 5.25 h, and 39.2 g of a 40% strength by weight sodium hydrogensulfite solution were metered in continuously over 5 h. Following after-stirring for two hours at 100° C., the reaction mixture was cooled to room temperature and adjusted to a pH of 7.2 by adding 50% strength by weight sodium hydroxide solution.

This gave a slightly yellowish, clear solution of the copolymer of molar composition AA:MAA:SEMA:MPEGMA=7.3:6.7:1:1 with a solids content of 23.1% by weight and a K value of 30.1.

Comparative Example V

In the reactor from Example 1, a mixture of 145.9 g of distilled water and 4.44 g of phosphorous acid was heated to an internal temperature of 100° C. with the introduction of nitrogen and with stirring. Then, a mixture of 139.8 g of acrylic acid, 100.5 g of 2-acrylamido-2-methylpropanesulfonic acid and 402 g of distilled water was added continuously over 5 h. In parallel to this, a mixture of 12.0 g of sodium peroxodisulfate and 108.2 g of distilled water was metered in continuously over 5.25 h, and 45.1 g of an 11.3% strength by weight sodium hydrogensulfite solution were metered in continuously over 5 h. Following after-stirring for one hour at 100° C., the reaction mixture was cooled to room temperature and adjusted to a pH of 7.2 by adding 50% strength by weight sodium hydroxide solution.

This gave a slightly yellowish, clear solution of the copolymer of molar composition AA:AMPA=1:4 with a solids content of 30.5% by weight and a K value of 33.0.

B) Use of copolymers containing sulfonic acid groups in dishwashing detergents

To test their deposit-inhibiting action, the resulting copolymers containing sulfonic acid groups were used together with a dishwashing detergent formulation having the following composition:

| | |
|---|---|
| 50% by weight | sodium tripolyphosphate ($Na_3P_3O_{10}$•6 $H_2O$) |
| 27% by weight | sodium carbonate |
| 3% by weight | sodium disilicate ($xNa_2O$•$ySiO_2$; x/y = 2.65; 80% strength) |
| 6% by weight | sodium percarbonate ($Na_2CO_3$•1.5 $H_2O_2$) |
| 2% by weight | tetraacetylenediamine (TAED) |
| 2% by weight | low-foam nonionic surfactant based on fatty alcohol alkoxylates |
| 3% by weight | sodium chloride |
| 5% by weight | sodium sulfate |
| 2% by weight | polyacrylic acid sodium salt ($M_w$ 8 000) |

The test was carried out under the following washing conditions without the addition of ballast soiling, with neither rinse aid nor regenerating salt being used:

Washing conditions:

| | |
|---|---|
| Dishwasher: | Miele G 686 SC |
| Wash programs: | 2 wash programs at 55° C. normal (without prewash) |
| Ware: | knives (WMF Tafelmesser Berlin, monoblock) and barrel-shaped glass beakers (Matador, Ruhr Kristall) |
| Dishwashing detergent: | 21 g |
| Copolymer: | 4.2 g |
| Clear-rinse temperature: | 65° C. |
| Water hardness: | 25° German hardness |

The ware was evaluated 18 h after washing by visual assessment in a black-painted light box with halogen spotlight and pinhole diaphragm using a grading scale from 10 (very good) to 1 (very poor). The highest grade 10 corresponds here to surfaces free from deposits and drops, from grades <5, deposits and drops are visible in normal room lighting, and are therefore regarded as troublesome.

The test results obtained are listed in the table below.

TABLE

| | Evaluation (grade) | |
|---|---|---|
| Copolymer from Ex. | Knives | Glasses |
| 1 | 7.7 | 7.4 |
| 2 | 8.5 | 8.0 |
| 3 | 9.0 | 8.0 |
| C | 7.5 | 6.0 |
| — | 4.0 | 4.0 |

We claim:

1. A method of machine washing dishes, comprising machine washing dishes with a composition comprising a copolymer containing sulfonic acid groups which comprises:

(a) 30 to 95 mol % of at least one monoethylenically unsaturated carboxylic acid, one monoethylenically unsaturated carboxylic ester or one water-soluble salt of a monoethylenically unsaturated carboxylic acid, (b) 3 to 35 mol % of at least one monomer containing sulfonic acid groups of the formula I $$H_2C{=}C(R){-}X{-}SO_3M \qquad (I)$$

wherein

R is hydrogen or methyl;

X is —COO—$R^1$—;

$R^1$ is unbranched or branched $C_1$-$C_4$-alkylene;

M is hydrogen, alkali metal or ammonium, and (c) 2 to 35 mol % of at least one nonionic monomer of the formula II

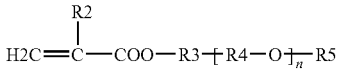

II wherein $R^2$ is hydrogen or methyl;

$R^3$ is a chemical bond or unbranched or branched $C_1$-$C_6$-alkylene;

$R^4$ are identical or different unbranched or branched $C_2$-$C_4$-alkylene radicals;

$R^5$ is unbranched or branched $C_1$-$C_6$-alkyl;

n is 3 to 50, in random or block copolymerized form.

2. The method of claim 1, wherein the copolymer comprises 50 to 90 mol % of component (a), 5 to 25 mol % of component (b) and 5 to 25 mol % of component (c) in copolymerized form.

3. The method of claim 1, wherein the monoethylenically unsaturated carboxylic acid (a) is acrylic acid, methacrylic acid and/or maleic acid.

4. The method of claim 1, wherein the monoethylenically unsaturated carboxylic acid (a) is acrylic acid or a mixture of acrylic acid and methacrylic acid.

5. The method of claim 1, wherein the copolymer comprises, as component (b), a monomer containing sulfonic acid groups of the formula I, in which R is methyl, X is —COO—$C_2H_4$— and M is sodium or hydrogen in copolymerized form.

6. The method of claim 1, wherein the copolymer comprises, as component (c), a nonionic monomer of the formula II, in which $R^2$ is methyl, $R^3$ is a chemical bond, $R^4$ is ethylene, $R^5$ is methyl and n is 10 to 30, in copolymerized form.

7. The method of claim 1, wherein the copolymers contain —$SO_3^-Na^+$ and/or —$SO_4^-Na^+$ as end-groups.

8. A method of inhibiting the formation of deposits during machine washing of dishes, comprising machine washing dishes with a composition comprising a copolymer containing sulfonic acid groups which comprises:

(a) 30 to 95 mol % of at least one monoethylenically unsaturated carboxylic acid, one monoethylenically unsaturated carboxylic ester or one water-soluble salt of a monoethylenically unsaturated carboxylic acid, (b) 3 to 35 mol % of at least one monomer containing sulfonic acid groups of the formula I $$H_2C{=}C(R){-}X{-}SO_3M \qquad (I)$$

wherein

R is hydrogen or methyl;

X is —COO—$R^1$—;

$R^1$ is unbranched or branched $C_1$-$C_4$-alkylene;

M is hydrogen, alkali metal or ammonium, and (c) 2 to 35 mol % of at least one nonionic monomer of the formula II

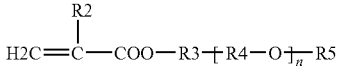

II wherein $R^2$ is hydrogen or methyl;

$R^3$ is a chemical bond or unbranched or branched $C_1$-$C_6$-alkylene;

$R^4$ are identical or different unbranched or branched $C_2$-$C_4$-alkylene radicals;

$R^5$ is unbranched or branched $C_1$-$C_6$-alkyl;

n is 3to 50, in random or block copolymerized form.

9. The method of claim 8, wherein the copolymer comprises 50 to 90 mol % of component (a), 5 to 25 mol % of component (b) and 5 to 25 mol % of component (c) in copolymerized form.

10. The method of claim 8, wherein the monoethylenically unsaturated carboxylic acid (a) is acrylic acid, methacrylic acid and/or maleic acid.

11. The method of claim 8, wherein the monoethylenically unsaturated carboxylic acid (a) is acrylic acid or a mixture of acrylic acid and methacrylic acid.

12. The method of claim 8, wherein the copolymer comprises, as component (b), a monomer containing sulfonic acid groups of the formula I, in which R is methyl, X is —COO—$C_2H_4$— and M is sodium or hydrogen in copolymerized form.

13. The method of claim 8, wherein the copolymer comprises, as component (c), a nonionic monomer of the formula II, in which $R^2$ is methyl, $R^3$ is a chemical bond, $R^4$ is ethylene, $R^5$ is methyl and n is 10 to 30, in copolymerized form.

14. The method of claim 8, wherein the copolymers contain —$SO_3^-Na^+$ and/or —$SO_4^-Na^+$ as end-groups.

15. In a method of machine washing dishes, the improvement comprising treating the dishes with a copolymer containing sulfonic acid groups which comprises:

(a) 30 to 95 mol % of at least one monoethylenically unsaturated carboxylic acid, one monoethylenically unsaturated carboxylic ester or one water-soluble salt of a monoethylenically unsaturated carboxylic acid, (b) 3 to 35 mol % of at least one monomer containing sulfonic acid groups of the formula I $$H_2C{=}C(R){-}X{-}SO_3M \qquad (I)$$

wherein

R is hydrogen or methyl;

X is —COO—$R^1$—;

$R^1$ is unbranched or branched $C_1$-$C_4$-alkylene;

M is hydrogen, alkali metal or ammonium, and (c) 2 to 35 mol % of at least one nonionic monomer of the formula II $$H2C{=}\overset{\overset{\displaystyle R2}{|}}{C}{-}COO{-}R3{-}\left[R4{-}O\right]_n{-}R5 \qquad II$$

wherein $R^2$ is hydrogen or methyl;

$R^3$ is a chemical bond or unbranched or branched $C_1$-$C_6$-alkylene;

$R^4$ are identical or different unbranched or branched $C_2$-$C_4$-alkylene radicals;

$R^5$ is unbranched or branched $C_1$-$C_6$-alkyl;

n is 3to 50, in random or block copolymerized form.

* * * * *